US008967852B2

(12) United States Patent
Pack et al.

(10) Patent No.: US 8,967,852 B2
(45) Date of Patent: Mar. 3, 2015

(54) MIXERS FOR IMMISCIBLE FLUIDS

(75) Inventors: Spencer D. Pack, West Des Moines, IA (US); Steven L. Smith, West Des Moines, IA (US)

(73) Assignee: Delavan Inc, West Des Moines, IA (US)

( * ) Notice: Subject to any disclaimer, the term of this patent is extended or adjusted under 35 U.S.C. 154(b) by 1203 days.

(21) Appl. No.: 12/884,938

(22) Filed: Sep. 17, 2010

(65) Prior Publication Data

US 2012/0069698 A1 Mar. 22, 2012

(51) Int. Cl.

| | |
|---|---|
| ***B01F 5/06*** | (2006.01) |
| ***B01F 5/00*** | (2006.01) |
| ***B01F 3/08*** | (2006.01) |
| ***B01F 5/04*** | (2006.01) |

(52) U.S. Cl.

CPC ..... *B01F 5/0065* (2013.01); *B01F 3/0807* (2013.01); *B01F 5/0473* (2013.01); *B01F 5/048* (2013.01); *B01F 5/0608* (2013.01); *B01F 2003/0842* (2013.01)

USPC ..... 366/165.2; 366/336

(58) Field of Classification Search

CPC .... B01F 5/0057; B01F 5/0065; B01F 5/0607; B01F 5/0606

USPC ..... 366/165.1, 165.2, 165.4, 165.5, 366/336–341

See application file for complete search history.

(56) References Cited

U.S. PATENT DOCUMENTS

| | | | | |
|---|---|---|---|---|
| 2,886,297 | A * | 5/1959 | Crandall | 366/76.91 |
| 3,450,022 | A * | 6/1969 | Engel | 99/453 |
| 3,526,391 | A * | 9/1970 | Church, Jr. | 366/340 |
| 3,794,299 | A * | 2/1974 | Wagner et al. | 210/198.1 |
| 4,092,013 | A * | 5/1978 | Staaf | 366/165.4 |
| 4,726,686 | A * | 2/1988 | Wolf et al. | 366/165.1 |
| 4,861,165 | A * | 8/1989 | Fredriksson et al. | 366/165.1 |
| 4,964,733 | A * | 10/1990 | Fredriksson et al. | 366/336 |
| 5,705,060 | A * | 1/1998 | Robberts | 210/198.1 |
| 7,018,435 | B1 * | 3/2006 | Wentinck | 48/198.8 |
| 7,175,337 | B2 * | 2/2007 | Bergman | 366/165.2 |
| 8,696,193 | B2 * | 4/2014 | Herbstritt | 366/338 |
| 2005/0247203 | A1 * | 11/2005 | Chevallet et al. | 96/209 |
| 2006/0164914 | A1 * | 7/2006 | Goto et al. | 366/165.2 |
| 2012/0069698 | A1 * | 3/2012 | Pack et al. | 366/165.2 |

* cited by examiner

*Primary Examiner* — Charles Cooley

(74) *Attorney, Agent, or Firm* — Locke Lord LLP; Scott D. Wofsy; Joshua L. Jones

(57) ABSTRACT

A mixer for mixing immiscible fluids includes a mixer housing defining a flow passage therethrough from a first fluid inlet to an outlet thereof. An upstream portion of the flow passage defines a main longitudinal axis. A second fluid inlet is provided downstream of the first fluid inlet in fluid communication with the upstream portion of the flow passage. The second fluid inlet is offset with respect to the main longitudinal axis of the flow passage to introduce fluid along a path that is offset with respect to the main longitudinal axis for inducing swirl on fluids introduced at the first and second fluid inlets. In certain embodiments, a mixer section is included having a flow constriction defined in a downstream portion of the flow passage with a flow area smaller than that of the upstream portion of the flow passage for enhancing turbulent mixing of fluids therein.

9 Claims, 10 Drawing Sheets

100
114
138
106
108
140

Fig. 13
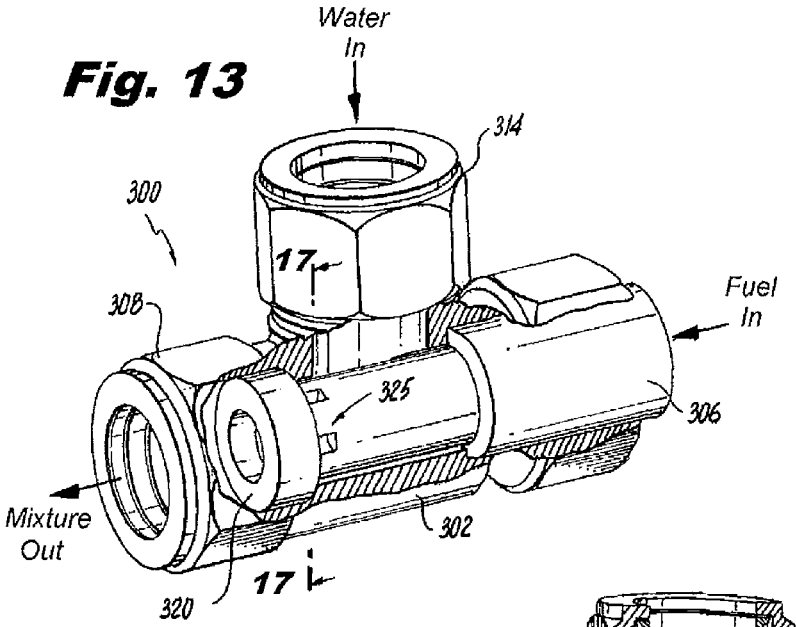
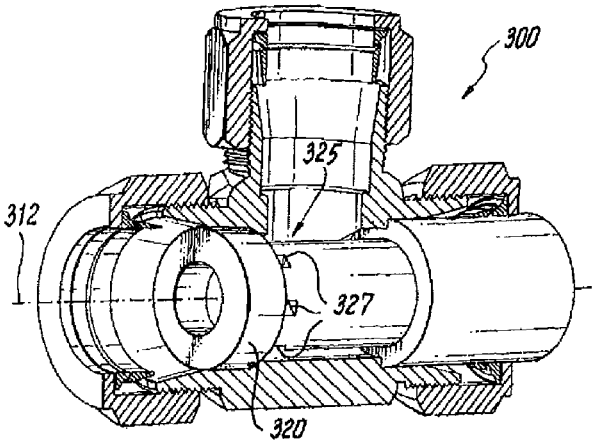
Fig. 14
Fig. 15
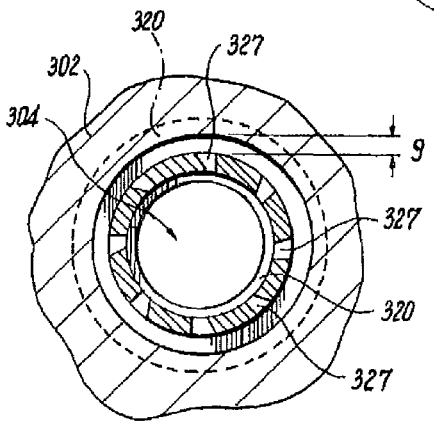

MIXERS FOR IMMISCIBLE FLUIDS

BACKGROUND OF THE INVENTION

1. Field of the Invention

The present invention relates to mixers for immiscible fluids, and more particularly to mixers for mixing fuel and water in gas turbine engines.

2. Description of Related Art

A variety of devices and methods are known in the art for injecting fuel into gas turbine engines. Of such devices, many are directed to injecting fuel into combustors of gas turbine engines while reducing undesirable emissions. Modern gas turbine engine designs use high temperature combustion for thermal efficiency throughout a range of engine operating conditions. High temperature combustion minimizes emissions of some undesired gaseous combustion products, such as carbon monoxide (CO) and unburned hydrocarbons (UHC), and particulates, among other things. However, high temperature combustion also tends to increase the production of nitrogen oxides ($NO_X$). Thus measures must be taken to provide thermally efficient operation within a temperature range that minimizes $NO_X$, CO, and UHC.

One method often used to reduce unwanted $NO_X$ emissions is to lower the temperature of combustion by injecting water into the combustor with the fuel. The water absorbs heat in the combustor, lowering the temperature of fuel combustion and reducing unwanted $NO_X$ emissions. Injecting water into the combustor is particularly advantageous in non-flight applications such as industrial gas turbine engines, where water supplies are readily available.

Injecting water into the combustor of a gas turbine engine presents challenges related to uniform distribution of water and fuel within the combustor. Some approaches to this problem have been to provide fuel injectors for the fuel that are separate from the injectors for the water, or to provide both fuel and water circuits within each injector with separate injection ports for fuel and water. These approaches attempt to provide uniform spray patterns of both fuel and water within the combustor, but add to the complexity and cost of the engine and maintenance. Another approach has been to inject water and fuel simultaneously through a single set of injectors by mingling the water and fuel together in the fuel lines prior to injection. The problem with this approach is that hydrocarbon fuel oil and water are immiscible. Simply mingling the two fluids together in a fuel line does not result in a uniform distribution of the fuel-water mixture at the injectors, since the two fluids tend to arrive at the injectors in a highly unmixed state.

Such conventional methods and systems have generally been considered satisfactory for their intended purpose. However, there is still an need in the art for mixers that allow for improved mixing of immiscible fluids. There also remains a need in the art for such mixers that are easy to make and use. The present invention provides a solution for these problems.

SUMMARY OF THE INVENTION

The subject invention is directed to a new and useful mixer for mixing immiscible fluids. The mixer includes a mixer housing defining a flow passage therethrough from a first fluid inlet to an outlet thereof. An upstream portion of the flow passage defines a main longitudinal axis. A second fluid inlet is defined in the mixer housing downstream of the first fluid inlet in fluid communication with the upstream portion of the flow passage. The second fluid inlet defines a secondary axis that is offset with respect to the main longitudinal axis of the flow passage to introduce fluid along a path that is offset with respect to the main longitudinal axis for inducing swirl on fluids introduced at the first and second fluid inlets.

In certain embodiments, the mixer also includes a mixer section having a flow constriction defined in a downstream portion of the flow passage with a flow area smaller than that of the upstream portion of the flow passage for enhancing turbulent mixing of fluids introduced at the first and second fluid inlets. The flow area of the flow constriction can define a centerline axis that is offset with respect to the main longitudinal axis of the flow passage. The mixer section can include two or more flow constrictions, wherein each flow constriction defines a centerline axis that is offset with respect to the centerline axis of the other flow constriction. Each flow constriction can be offset with respect to the main longitudinal axis of the flow passage. It is also contemplated that the centerline axis of each flow constriction can be offset in a direction opposite that of the centerline axis of the other flow constriction with respect to the main longitudinal axis of the flow passage.

In certain embodiments, an upstream one of two flow constrictions includes a beveled upstream inlet and a beveled downstream outlet to form a converging, diverging flow path therethrough for reducing pressure loss. Bevel features, chamfers, or filet radius features can be included on either or all flow constrictions. A downstream one of two flow constrictions can include opposed upstream and downstream faces that are oriented substantially perpendicular to the main longitudinal axis. The two flow constrictions can be separated by a spin chamber defined in the flow passage of the mixer housing, and the spin chamber can have a flow area substantially equal in size with that of the upstream portion of the flow passage.

The outlet of the mixer housing can define an outlet axis that is substantially concentric with the main longitudinal axis of the flow passage. It is also contemplated that the secondary axis defined by the second fluid inlet can be oriented substantially perpendicular, or on any other suitable angle, and offset with respect to the main longitudinal axis of the flow passage. The mixer can further include an outlet conduit mounted in fluid communication with the outlet of the mixer housing, wherein the outlet conduit includes a bend therein to promote mixing of fluids introduced in the first and second fluid inlets.

The invention also provides a mixer for mixing immiscible fluids wherein the second fluid inlet is defined in the mixer housing downstream of the first fluid inlet in fluid communication with the upstream portion of the flow passage, and a mixer section including a pair of flow constrictions is defined in a downstream portion of the flow passage. The flow constrictions each have a flow area smaller than that of the upstream portion of the flow passage for enhancing turbulent mixing of fluids introduced at the first and second fluid inlets. Each flow constriction defines a centerline axis that is offset with respect to the centerline axis of the other flow constriction.

The invention also provides a mixer for mixing immiscible fluids in which the second fluid inlet includes a swirl inducer. A mixer housing defines a flow passage therethrough from a first fluid inlet to an outlet thereof. The flow passage defines a main longitudinal axis. A second fluid inlet is defined in the mixer housing downstream of the first fluid inlet in fluid communication with the flow passage and oriented at an angle with respect to the main longitudinal axis. The second fluid inlet includes a swirl inducer for inducing swirl on fluids flowing through the flow passage. A flow constriction is defined in the flow passage downstream of the second fluid inlet having a flow area smaller than that of the flow passage upstream thereof for accelerating a swirling flow of fluids flowing through the flow passage to enhance turbulent mixing of fluids introduced at the first and second fluid inlets.

In certain embodiments, the swirl inducer includes a flow obstruction configured to direct flow through the second fluid inlet into the flow passage asymmetrically with respect to the main longitudinal axis. The flow obstruction of the second fluid inlet is configured to direct a single flow through the second fluid inlet into the flow passage that is predominantly offset with respect to the main longitudinal axis of the flow passage.

In accordance with certain embodiments, the swirl inducer includes a swirler mounted in the flow passage and configured to introduce fluid from the second fluid inlet into the flow passage through a plurality of swirl inlets defined through the swirler to impart swirl onto fluids flowing through the flow passage. The swirler can be a radial swirler and the swirl inlets can be radially offset with respect to the main longitudinal axis to impart swirl onto fluids flowing through the flow passage. It is also contemplated that the flow constriction and swirler can be substantially concentric with the main longitudinal axis of the flow passage.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 13 is a partially cut away perspective view of another exemplary embodiment of a mixer constructed in accordance with the present invention, showing the two fluid inlets and the fluid outlet;

FIG. 14 is a partial cross-sectional perspective view of the mixer of FIG. 13, showing the radial swirler with radially offset swirl inlets; and FIG. 15 is a cross-sectional end elevation view of a portion of the mixer of FIG. 13, showing the radial gap between the housing and the radial swirler.

DETAILED DESCRIPTION OF THE PREFERRED EMBODIMENTS

Figure 1:
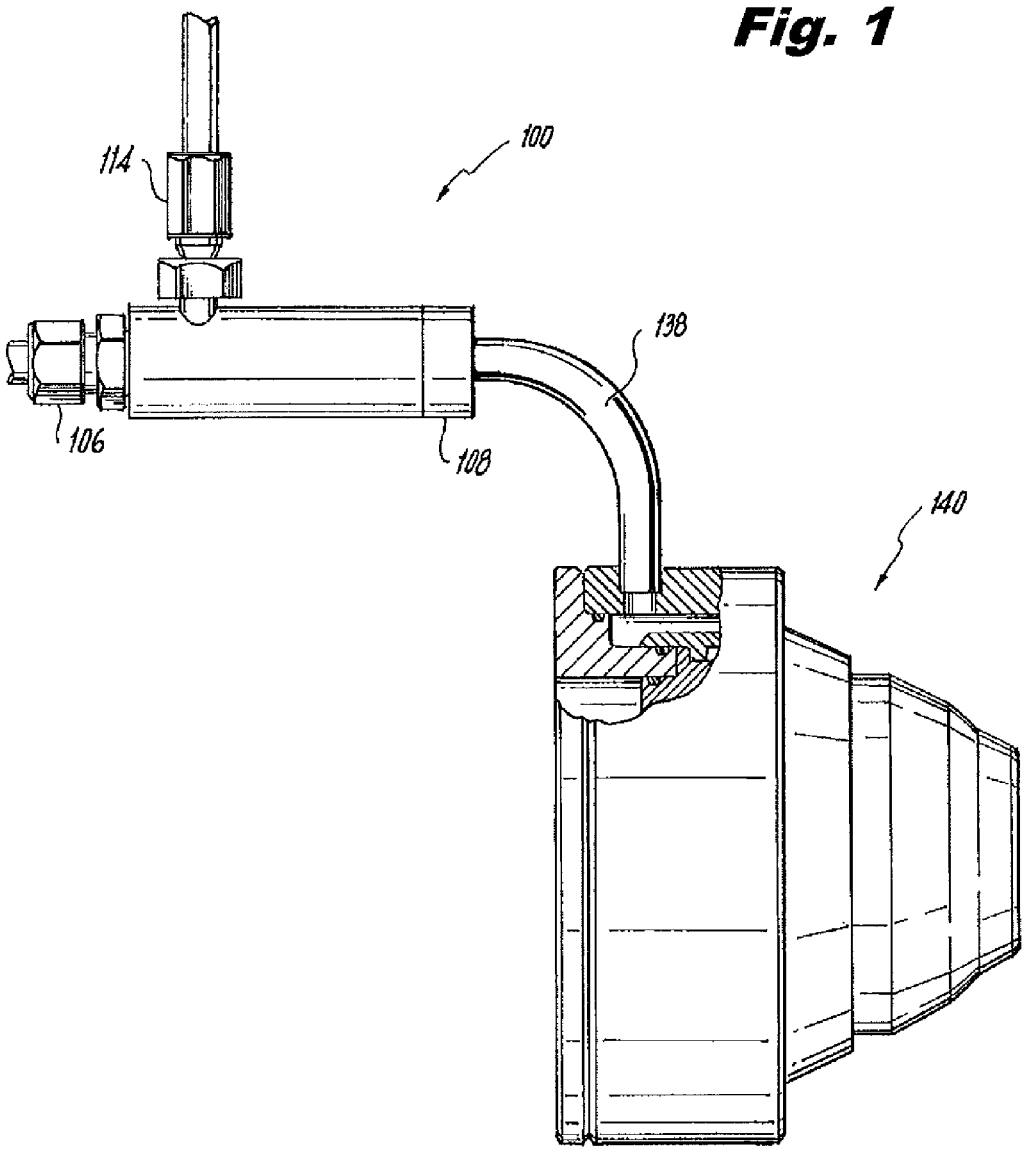
FIG. 1 is a side elevation view of an exemplary embodiment of a mixer constructed in accordance with the present invention, showing two fluid inlets and an outlet for mixed fluids joined to an atomizer nozzle.

Reference will now be made to the drawings wherein like reference numerals identify similar structural features or aspects of the subject invention. For purposes of explanation and illustration, and not limitation, a partial view of an exemplary embodiment of a mixer in accordance with the invention is shown in FIG. 1 and is designated generally by reference character 100. Other embodiments of mixers in accordance with the invention, or aspects thereof, are provided in FIGS. 2-15, as will be described. The systems of the invention can be used to mix fluids together, including immiscible fluids, for example for delivering a water/fuel oil emulsion to a fuel nozzle for a low $NO_X$ gas turbine combustion system.

Figure 2:
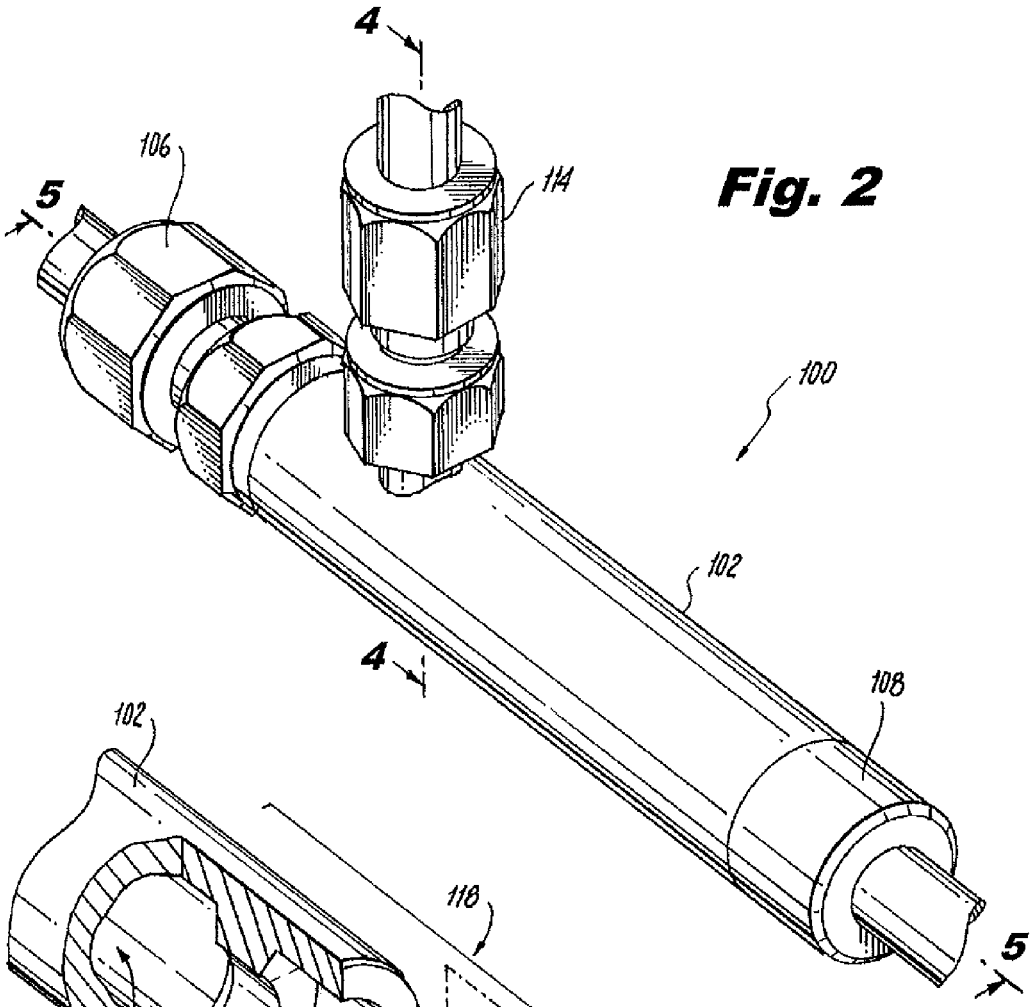
FIG. 2 is a perspective view of the mixer of FIG. 1, showing the offset fluid inlet for inducing swirl on the mixture of fluids within the mixer.

Referring now to FIGS. 1-2, mixer 100 has two inlets 106, 114 for receiving two different fluids, for example water and fuel, respectively. While discussed herein in the exemplary context of inlet 106 being used for water and inlet 114 being used for fuel, those skilled in the art will readily appreciate that the fluids received at each inlet can be switched, or that any other suitable fluids can be used without departing from the spirit and scope of the invention. Both of the different fluids are mixed throughout mixer 100 and the mixture is conveyed from outlet 108 through a conduit 138 to an atomizer 140.

Figure 3:
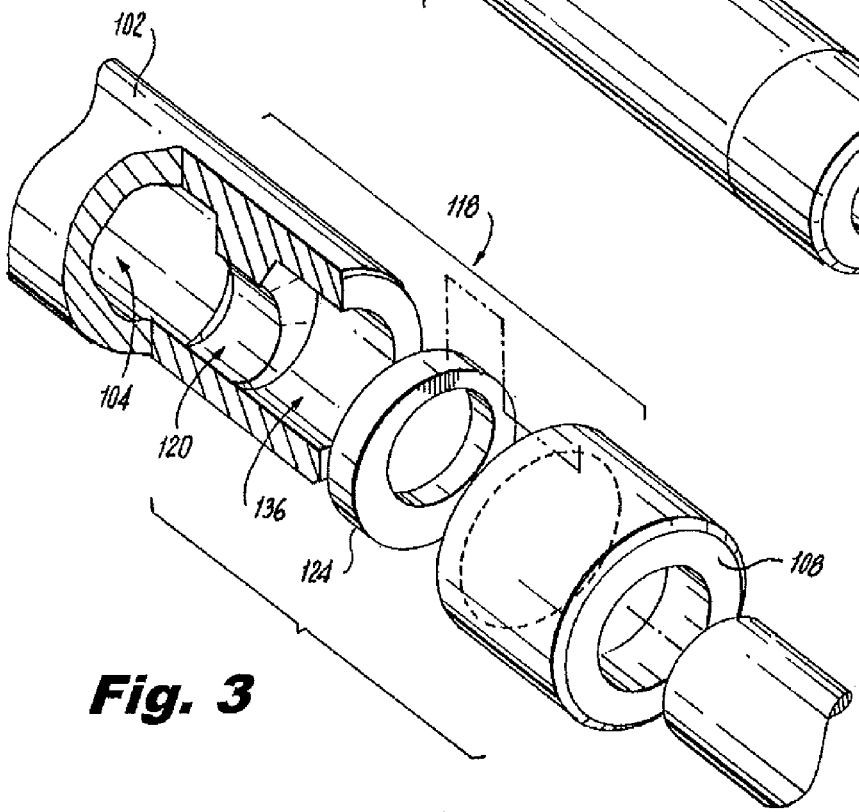
FIG. 3 is an exploded, partial cross-sectional perspective view of the mixer of FIG. 1, showing the mixer section downstream of the offset fluid inlet for inducing turbulence on the flow of mixed fluids in the mixer.
Figure 4:
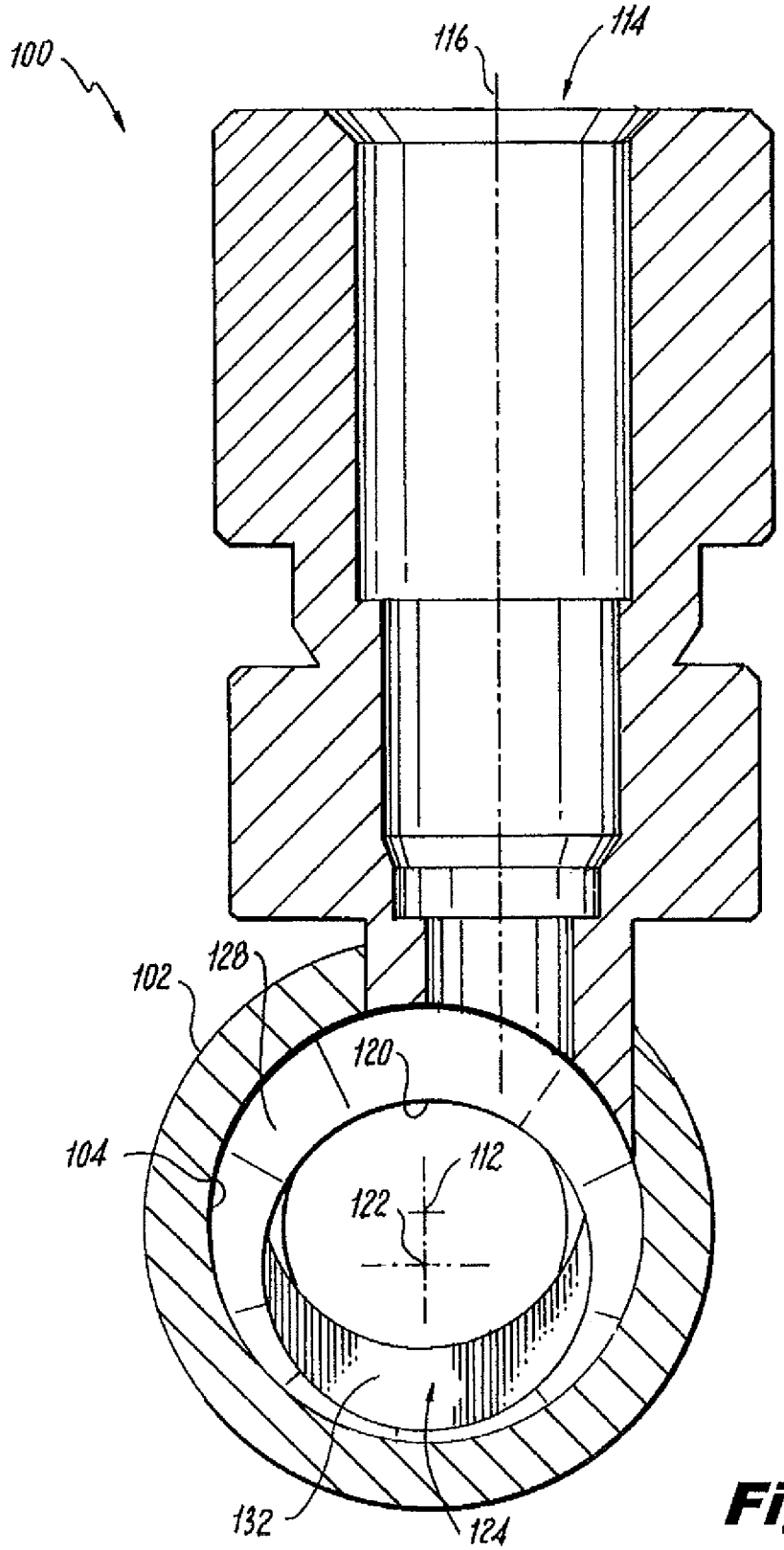
FIG. 4 is a cross-sectional end elevation view of the mixer of FIG. 1, showing the axis of the offset fluid inlet, which is offset with respect to the longitudinal axis of the main fluid passage of the mixer.
Figure 5:
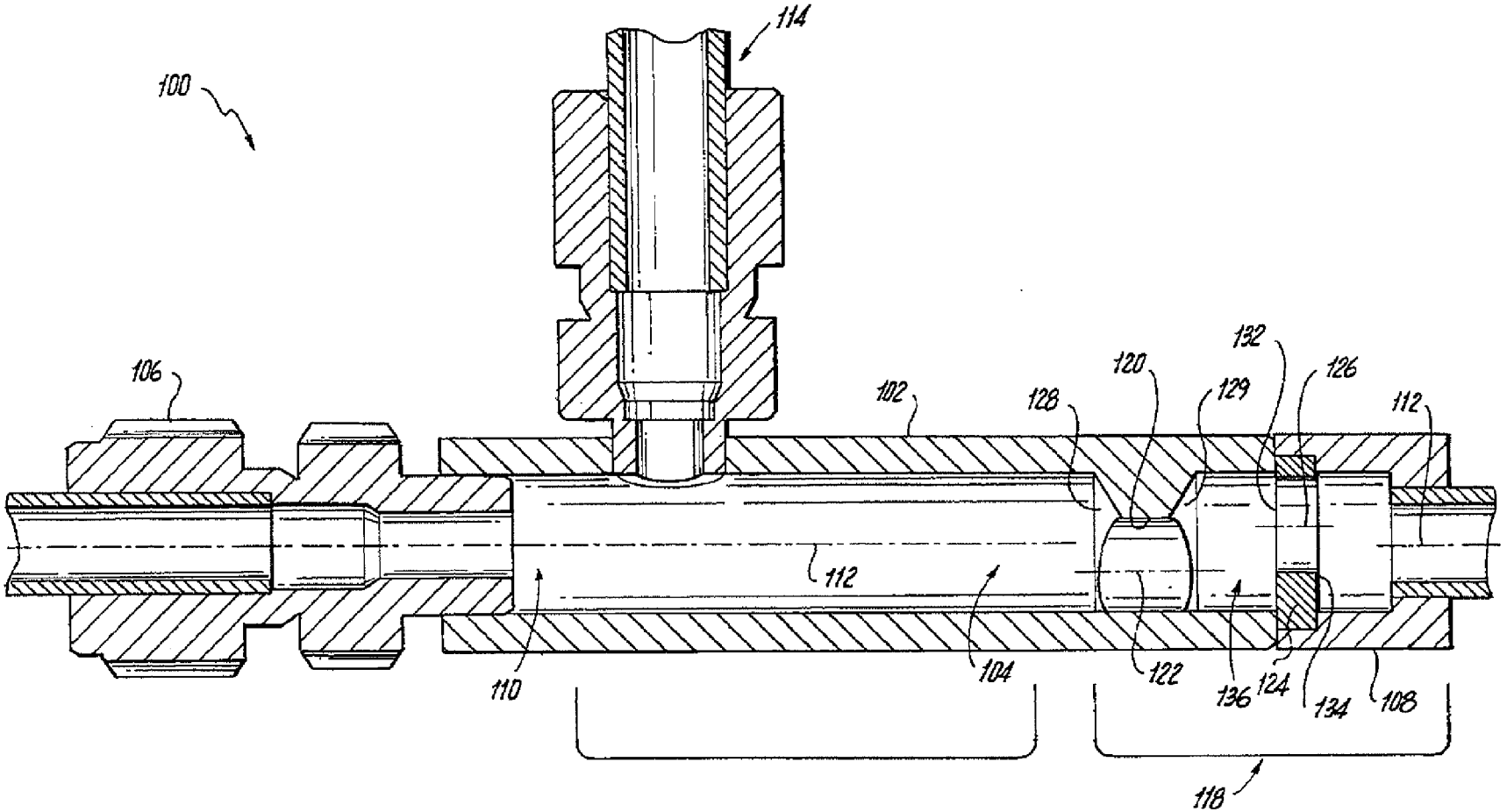
FIG. 5 is a cross-sectional side elevation view of a portion of the mixer of FIG. 1, showing the offset axes of the mixer section.

With reference now to FIGS. 2-5, mixer 100 includes a mixer housing 102 defining a flow passage 104 running therethrough from inlet 106 to outlet 108. An upstream portion 110 of flow passage 104, shown in FIG. 5, defines a main longitudinal axis 112. A second fluid inlet 114 is defined in mixer housing 102 downstream of first fluid inlet 106 in fluid communication with upstream portion 110 of flow passage 104. As can be seen in FIG. 4, second fluid inlet 114 defines a secondary axis 116 that is offset with respect to main longitudinal axis 112 of flow passage 104 to introduce fluid along a path that is offset with respect to main longitudinal axis 112 for inducing swirl on fluids introduced at first and second fluid inlets 106, 114. Secondary axis 116 and second fluid inlet 114 are oriented substantially perpendicular to main longitudinal axis 112 of flow passage 104, so inlets 106, 114 and outlet 108 form a T-shaped mixer configuration, as shown in FIGS. 1 and 5.

With reference to FIGS. 3 and 5, mixer 100 includes a non-coaxial mixer section 118 having a first flow constriction 120 defined in a downstream portion of flow passage 104 with a flow area smaller than that of upstream portion 110 of flow passage 104 for enhancing turbulent mixing of fluids introduced at first and second fluid inlets 106, 114. The flow area of first flow constriction 120 defines a centerline axis 122 that is offset with respect to main longitudinal axis 112 of flow passage 104, as indicated in FIG. 5. Mixer section 118 includes a second flow constriction 124 downstream of first flow constriction 120. Second flow constriction 124 defines a centerline axis 126 that is offset with respect to centerline axis 122 of first flow constriction 120. The respective flow area of each flow constriction 120, 124 is offset with respect to main longitudinal axis 112 of flow passage 104. Flow constrictions 120, 124 are offset in opposite directions from each other with respect to main longitudinal axis 112, i.e., the centerline axis 122, 126 of each flow constriction 120, 124 is offset in a direction opposite the direction the other flow constriction 120, 124 with respect to main longitudinal axis 112. Those skilled in the art will readily appreciate that this 180° angular separation of the relative offset of axes 122, 126 achieves greater mixing than smaller angular separations, and that this is exemplary, as any other suitable angular separation can be used without departing from the spirit and scope of the invention.

Flow constriction 124 is provided as a disc with an off-center orifice formed therethrough, as shown in FIG. 3. The disc of flow constriction 124 can be assembled into housing 102 as a separate piece, properly oriented with respect to its offset axis 126 by mounting it between the main portion of housing 102 and outlet 108 by any suitable joining technique such as welding or brazing.

Figure 6:
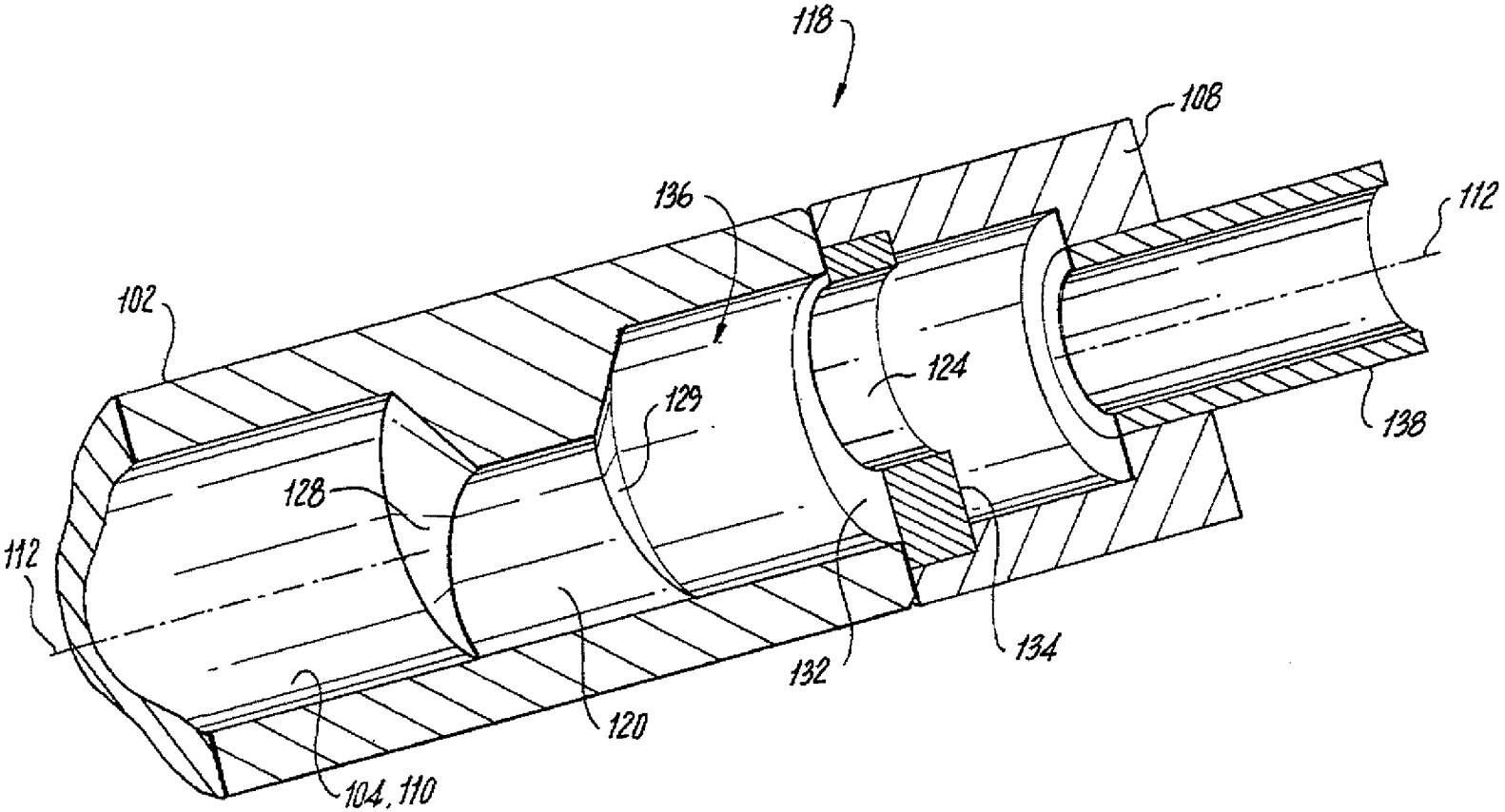
FIG. 6 is a cross-sectional perspective view of a portion of the mixer of FIG. 1, showing the flow obstructions in the mixer section.

With reference now to FIG. 6, first flow constriction 120 includes a beveled upstream inlet 128 and a beveled downstream outlet 129 to form a converging, diverging flow path therethrough for reducing pressure loss. Second flow constriction 124 includes an upstream face 132 and an opposed downstream face 134 that are oriented substantially perpendicular to main longitudinal axis 112 to enhance turbulent mixing. Those skilled in the art will readily appreciate that any suitable combination of beveled features, chamfers, or filet radii may be used on the upstream and/or downstream portions of any or all of the flow constrictions to achieve an appropriate tradeoff between operational pressure drop, mixing levels, and cost of manufacturing for a given application. The two flow constrictions 120, 124 are separated by a spin chamber 136 defined in flow passage 104 of mixer housing 102. Spin chamber 136 has a flow area substantially equal in size with that of upstream portion 110 of flow passage 104.

Outlet 108 of mixer housing 102 defines an outlet axis that is substantially concentric with main longitudinal axis 112 of flow passage 104. An outlet conduit 138 is mounted in fluid communication with outlet 108 of mixer housing 102. As shown in FIG. 1, outlet conduit 138 advantageously includes an optional bend therein to promote mixing of fluids introduced in the first and second fluid inlets 106, 114 by the effect of Coriolis forces. Outlet conduit 138 connects flow passage 104 in fluid communication with an injector such as airblast atomizer 140. As shown, the bend in conduit 138 is angled at about 90°, however it is contemplated that the bend can include any suitable amount of bend, including a helical bend with multiple revolutions, or no bend at all.

Figure 7:
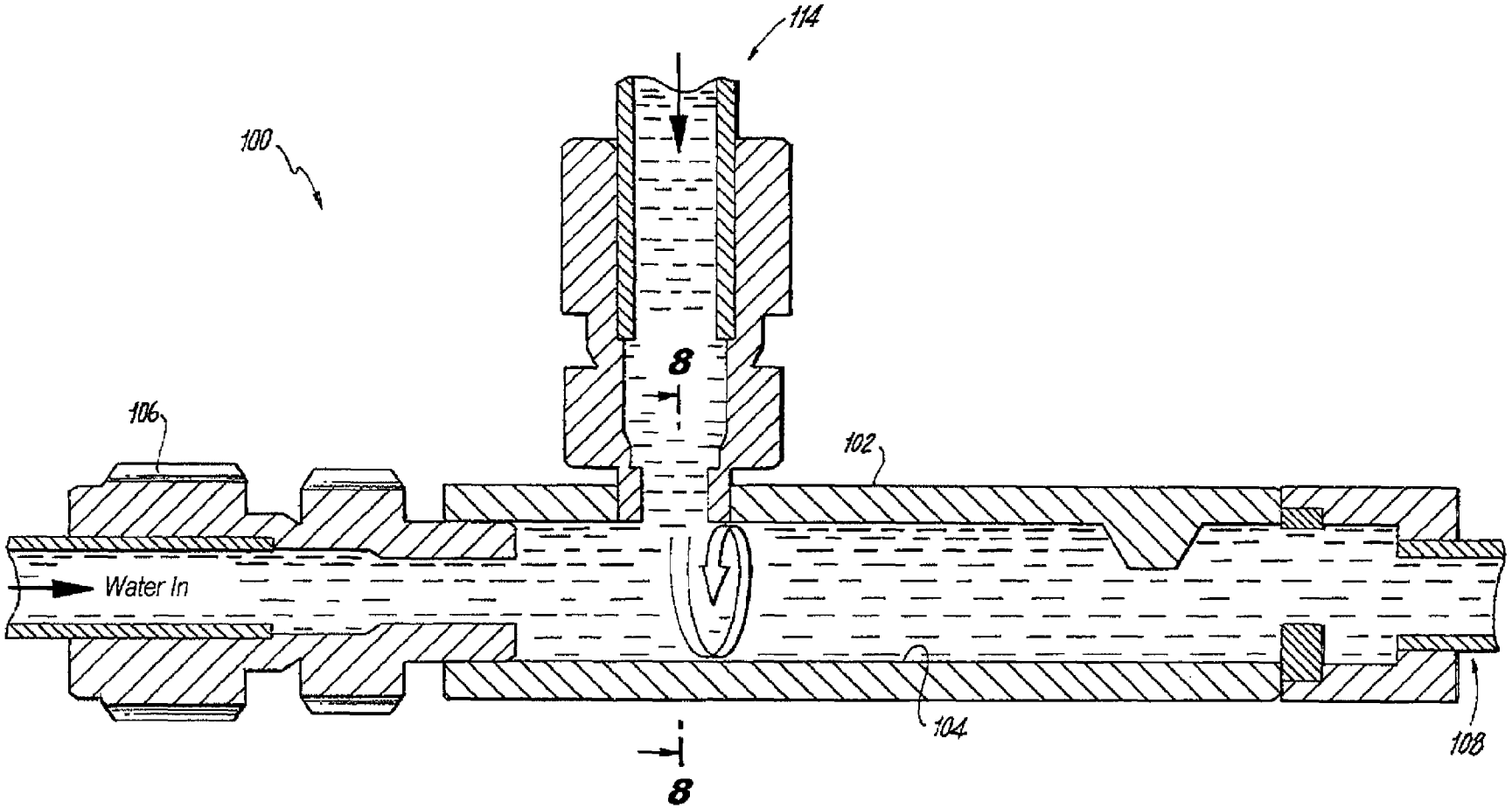
FIG. 7 is a cross-sectional side elevation view of a portion of the mixer of FIG. 1, schematically showing swirling flow induced on the main fluid passage by the fluids entering the offset inlet.
Figure 8:
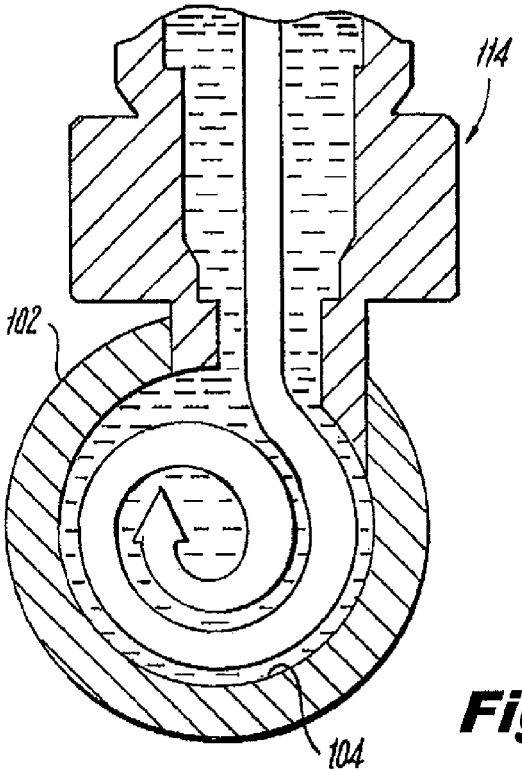
FIG. 8 is a cross-sectional side elevation view of a portion of the mixer of FIG. 1, schematically showing swirling flow induced on the main fluid passage by the fluids entering the offset inlet.

The flow patterns within mixer 100 are described with reference now to FIGS. 7-9. Since second inlet 114 is radially offset with respect to axis 112, fluids flowing into mixer 100 through inlet 114 induce swirl on the flow within flow passage 104 downstream of inlet 114. The swirling motion induced on the mixture, for example fuel and water, is indicated schematically in FIGS. 7-8 by the swirl arrows in flow passage 104. Introducing a perpendicular flow from second inlet 114 also results in momentum exchange between the fluids from inlets 106, 114 and generates turbulence which aids the initial mixing of the two fluids introduced at the respective inlets 106, 114. This swirling motion from the offset axis of second inlet 114 induces swirl to further enhance preliminary mixing.

Figure 9:
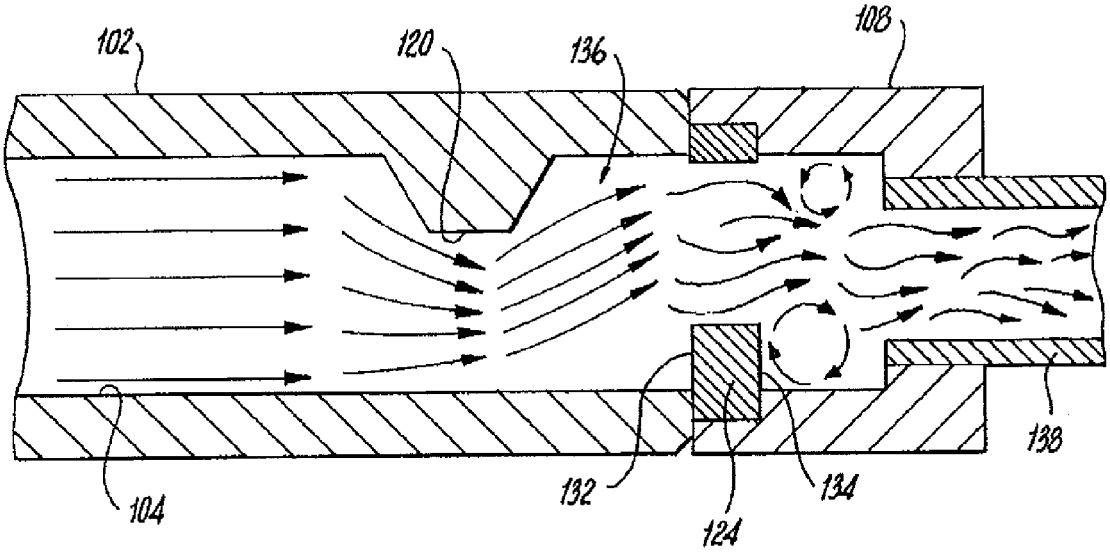
FIG. 9 is a cross-sectional side elevation view of a portion of the mixer of FIG. 1, schematically showing the acceleration and turbulence imparted by the mixer section on the flow through the main fluid passage.

The swirling flow within flow passage 104 is accelerated through the converging-diverging constriction 120, as indicated schematically by the arrows in FIG. 9, forming a high velocity jet that further enhances the swirl and mixing. As oriented in FIG. 9, constriction 120 forces the mixing flow downward, but the flow is forced to flow back upward within swirl chamber 136 by flow constriction 124, where a second high velocity jet is formed. Downstream of flow constriction 124, the flow is again forced downward to leave housing 102 via outlet 108. Flowing through the offset axes within mixer section 118 contributes to turbulence and mixing, as the two jets formed in constrictions 120, 124 impinge on downstream internal structures. Axial acceleration in the two jets helps keep water and oil from separating centrifugally as the mixture swirls.

The abrupt upstream and downstream faces 132, 134 of constriction 124 give rise to eddies and turbulence downstream of constriction 124, which further enhance mixing in the swirling flow through flow passage 104. When used to mix fuel oil with water, for example, this impingement directly causes fuel oil breakup and mixing and generates additional freestream turbulence to enhance downstream mixing. While mixer 100 has been described above as an exemplary embodiment having two flow constrictions 120, 124, those skilled in the art will readily appreciate that any suitable number of flow constrictions can be used without departing from the spirit and scope of the invention. Care should be used in selecting the number of flow constrictions for a given application, as too many flow constrictions can cause to an undesirable pressure drop and unnecessary increases in manufacturing costs.

As indicated above, the bend in conduit 138 adds to the mixing effectiveness by way of Coriolis forces. While the effects of offset second inlet 114, mixer section 118, and the bend in conduit 138 combine advantageously to enhance mixing, those skilled in the art will readily appreciate that one or more of these features can be omitted without departing from the spirit and scope of the invention.

Figure 10:
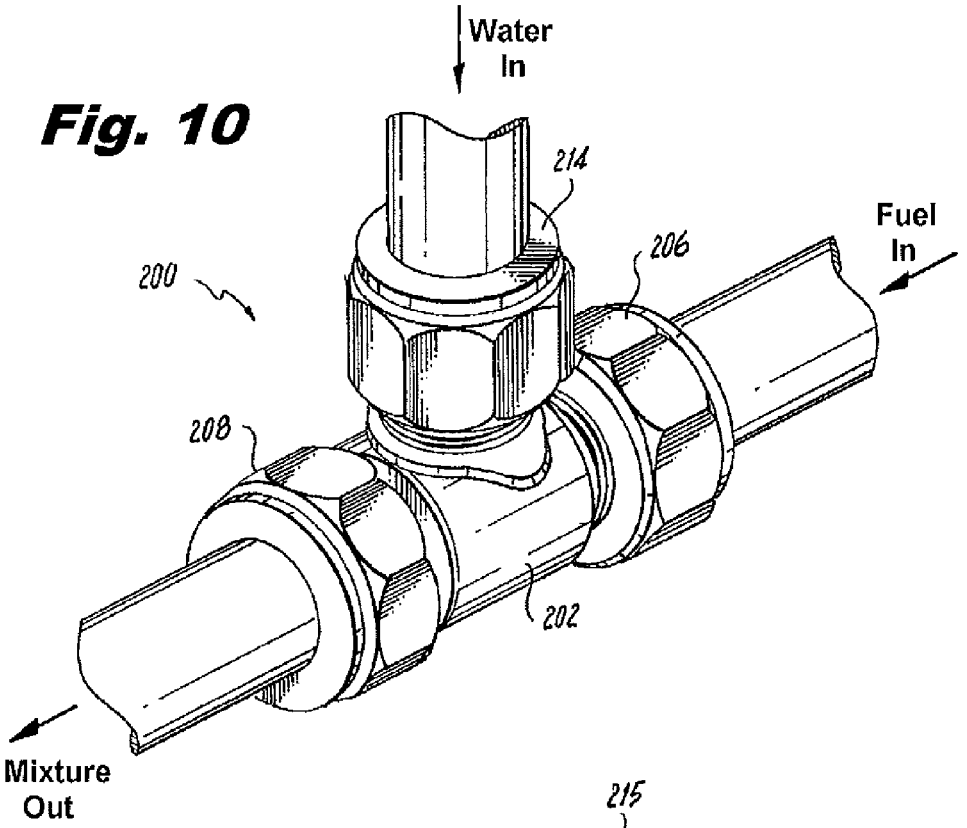
FIG. 10 is a perspective view of another exemplary embodiment of a mixer constructed in accordance with the present invention, showing the two fluid inlets and the fluid outlet.
Figure 11:
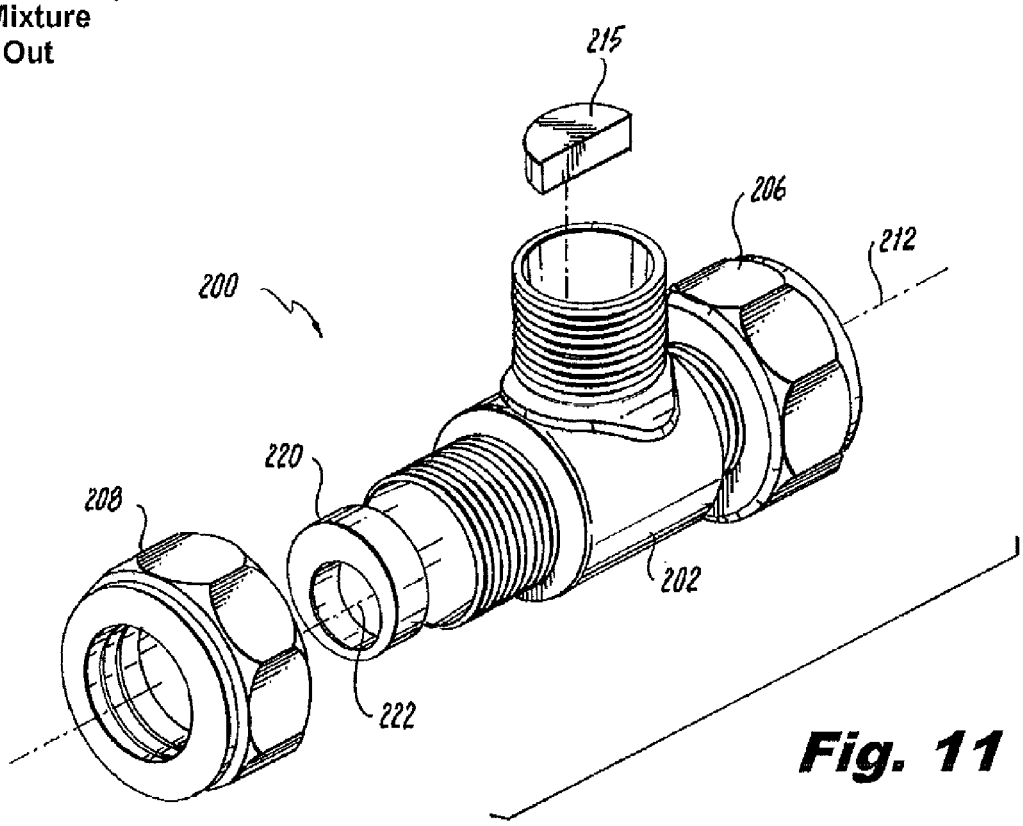
FIG. 11 is a partially exploded perspective view of the mixer of FIG. 10, showing the flow obstruction insert and flow constriction insert.
Figure 12:
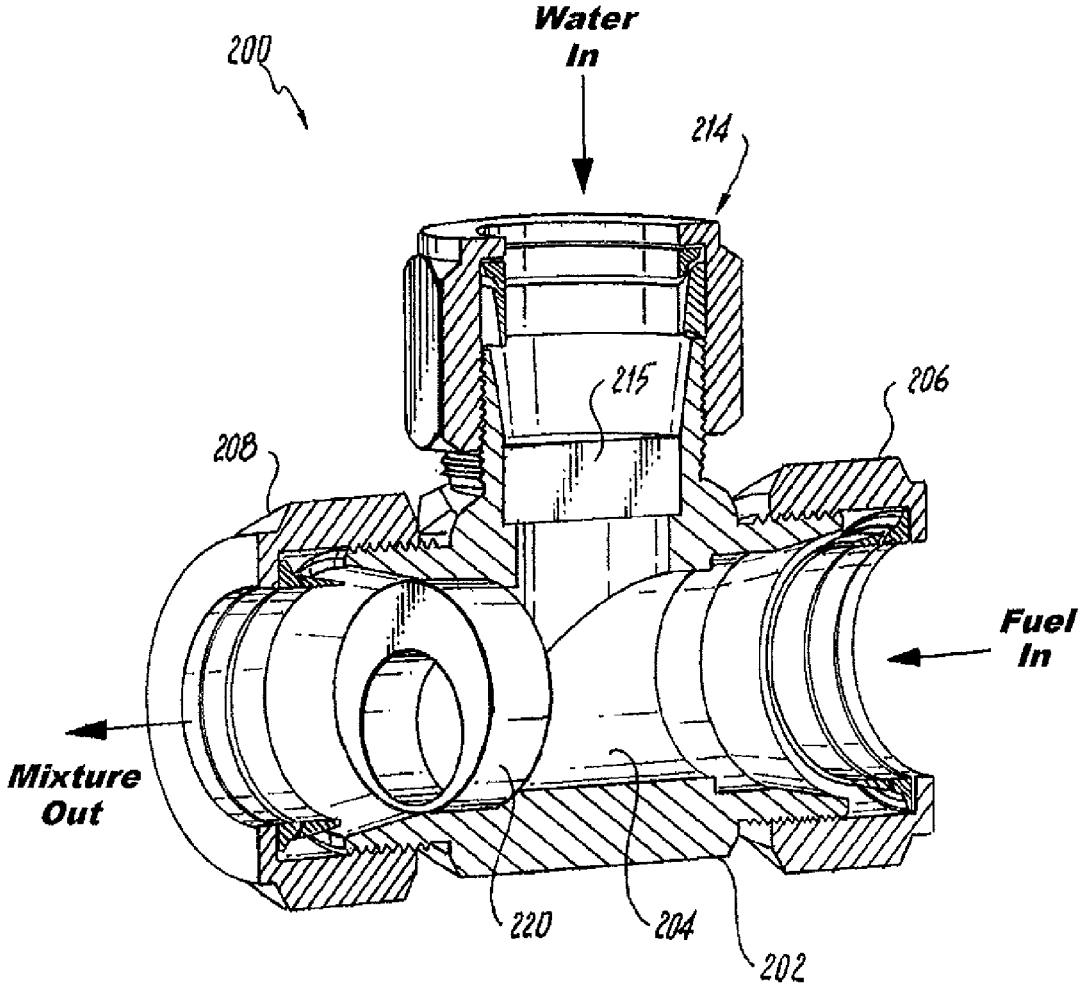
FIG. 12 is a cross-sectional perspective view of the mixer of FIG. 10, showing the internal flow passage.

Referring now to FIGS. 10-12, another exemplary embodiment of a mixer 200 is shown for mixing immiscible fluids in which the second fluid inlet includes a swirl inducer. As shown in FIG. 12, a mixer housing 202 defines a flow passage 204 therethrough from a first fluid inlet 206 to an outlet 208 thereof. Flow passage 204 defines a main longitudinal axis 212, indicated in FIG. 11. A second fluid inlet 214 is defined in mixer housing 202 downstream of first fluid inlet 206 in fluid communication with flow passage 204 and oriented at a substantially perpendicular angle with respect to flow passage 204 and main longitudinal axis 212. While described herein with exemplary embodiments having the second fluid inlet oriented perpendicular to the respective main longitudinal axis, those skilled in the art will readily appreciate that any other suitable angle can be used for the orientation of the second fluid inlet without departing from the spirit and scope of the invention.

With reference now to FIGS. 11-12, second fluid inlet 214 includes a swirl inducer, namely flow obstruction 215, for inducing swirl on fluids flowing through flow passage 204.

Flow obstruction 215 is generally semi-circular and is configured to block off approximately one half of inlet 214 to direct flow through second fluid inlet 214 into flow passage 204 asymmetrically with respect to main longitudinal axis 212. While second inlet 214 is itself substantially centered with respect to flow passage 204 and axis 212, flow obstruction 215 directs a single flow through second fluid inlet 214 into the fluid passage 204 that is predominantly off-center with respect to fluid passage 204 and axis 212. Those skilled in the art will readily appreciate that any suitable shape can be used for a flow obstruction 215 without departing from the spirit and scope of the invention.

A flow constriction 220, similar to constriction 124 described above, is defined in flow passage 204 downstream of second fluid inlet 214. Flow constriction 220 has a flow area therethrough that is smaller than that of flow passage 204 upstream thereof for accelerating a swirling flow of fluids flowing through flow passage 204 to enhance turbulent mixing of fluids introduced at the first and second fluid inlets 206, 214. The flow area of flow constriction 220 defines a central axis 222 that is offset from main longitudinal axis 212, to enhance mixing much as described above with respect to flow constriction 120. The resulting flow pattern is much like that of mixer 100 described above.

Referring now to FIGS. 13-15, another exemplary embodiment of a mixer 300 is shown which includes a radial swirler. Mixer 300 includes a mixer housing 302, flow passage 304, first fluid inlet 306, outlet 308, main longitudinal axis 312, and second fluid inlet 314 much as those described above with respect to mixer 200. In mixer 300, the swirl inducer includes a swirler 325 mounted in flow passage 304.

Swirler 325 is a radial swirler configured to introduce fluid, such as water, from second fluid inlet 314 into flow passage 304 through a plurality of swirl inlets 327 defined through swirler 325 to impart swirl onto fluids flowing through flow passage 304. Since fluid entering fluid passage 304 through second fluid inlet 314 must pass through swirl inlets 327, which are radially offset with respect to main longitudinal axis 312, swirl is imparted to fluids flowing through flow passage 304.

Flow constriction 320 is similar to flow constriction 220 described above, but has a flow area therethrough that is substantially concentric with the respective main longitudinal axis. Swirler 325 is also substantially concentric with axis 312. The resulting flow pattern is much like that of mixer 100 described above. Even though flow constriction 320 is not offset, it nonetheless enhances mixing by accelerating the swirling flow passing therethrough, increasing turbulence. Those skilled in the art will readily appreciate that flow constrictions that are either offset or concentric can be used to enhance mixing in any of the embodiments described above without departing from the spirit and scope of the invention.

As indicated in FIG. 13, mixer 100 is configured to receive fuel at first inlet 306 and water at second inlet 314. Those skilled in the art will readily appreciate that water can be introduced at first inlet 306 and fuel can be introduced at second inlet 314. Moreover, any other suitable fluids can be mixed without departing from the spirit and scope of the invention.

Computational fluid dynamics analyses used to investigate and demonstrate fuel and water mixing in a variety of geometric configurations has demonstrated that mixers constructed in accordance with the present invention provide a substantially uniform mixture that can be injected from injectors. Mixtures having a range of fuel volume fraction of around 32% to 39% at the outlet, where the ideal fraction of fuel by volume is 34%, have been demonstrated by the analysis.

While the mixers described herein have been explained in the exemplary context of assembling, brazing, and welding, those skilled in the art will readily appreciate that any suitable fabrication techniques can be used without departing from the spirit and scope of the invention. For example, direct metal laser sintering can be used to fabricate mixers in an additive manner. As further examples, inner diameter splines, posts, tapered bores, or any other suitable geometric approaches can also be used to form the turbulence generating features of mixers in accordance with the invention.

The methods and systems of the present invention, as described above and shown in the drawings, provide for mixing fluids with superior properties including enhanced mixing of immiscible liquids, for example. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A mixer for mixing immiscible fluids comprising:

a) a mixer housing defining a flow passage therethrough from a first fluid inlet to an outlet thereof, an upstream portion of the flow passage defining a main longitudinal axis; and b) a second fluid inlet defined in the mixer housing downstream of the first fluid inlet in fluid communication with the upstream portion of the flow passage, the second fluid inlet defining a secondary axis that is offset with respect to the main longitudinal axis of the flow passage to introduce fluid along a path offset with respect to the main longitudinal axis for inducing swirl on fluids introduced at the first and second fluid inlets, further comprising a mixer section including a flow constriction defined in a downstream portion of the flow passage with a flow area smaller than that of the upstream portion of the flow passage for enhancing turbulent mixing of fluids introduced at the first and second fluid inlets, wherein the mixer section includes two flow constrictions, wherein each flow constriction defines a flow area having a centerline axis that is offset with respect to the centerline axis of the flow area of the other flow constriction, wherein an upstream one of the two flow constrictions includes a beveled upstream surface converging to a cylindrical flow area defining the centerline axis thereof that is offset with respect to the main longitudinal axis, and a beveled downstream surface diverging away from the cylindrical flow area to form a converging, diverging flow path therethrough for reducing pressure loss.

2. A mixer as recited in claim 1, wherein the centerline axis of each flow area is offset with respect to the main longitudinal axis of the flow passage.

3. A mixer as recited in claim 2, wherein the centerline axis of each flow area is offset in a direction opposite that of the centerline axis of the other flow area with respect to the main longitudinal axis of the flow passage.

4. A mixer as recited in claim 1, wherein a downstream one of the two flow constrictions includes opposed upstream and downstream faces that are oriented substantially perpendicular to the main longitudinal axis.

5. A mixer as recited in claim 1, wherein the two flow constrictions are separated by a spin chamber defined in the flow passage of the mixer housing, wherein the spin chamber has a flow area substantially equal in size with that of the upstream portion of the flow passage.

6. A mixer as recited in claim 1, wherein the outlet of the mixer housing defines an outlet axis substantially concentric with the main longitudinal axis of the flow passage.

7. A mixer as recited in claim 1, wherein the secondary axis defined by the second fluid inlet is oriented substantially perpendicular and offset with respect to the main longitudinal axis of the flow passage.

8. A mixer as recited in claim 1, further comprising an outlet conduit mounted in fluid communication with the outlet of the mixer housing, wherein the outlet conduit includes a bend therein to promote mixing of fluids introduced in the first and second fluid inlets.

9. A mixer for mixing immiscible fluids comprising:

a) a mixer housing defining a flow passage therethrough from a first fluid inlet to an outlet thereof, an upstream portion of the flow passage defining a main longitudinal axis;

b) a second fluid inlet defined in the mixer housing downstream of the first fluid inlet in fluid communication with the upstream portion of the flow passage; and c) a mixer section including a pair of flow constrictions defined in a downstream portion of the flow passage each defining a flow area smaller than that of the upstream portion of the flow passage for enhancing turbulent mixing of fluids introduced at the first and second fluid inlets, wherein each flow constriction defines a flow area having a centerline axis that is offset with respect to the centerline axis of the other flow constriction, wherein an upstream one of the two flow constrictions includes a beveled upstream surface converging to a cylindrical flow area defining the centerline axis thereof that is offset with respect to the main longitudinal axis, and a beveled downstream surface diverging away from the cylindrical flow area to form a converging, diverging flow path therethrough for reducing pressure loss.

* * * * *